United States Patent [19]

Galvin et al.

[11] 4,117,479

[45] Sep. 26, 1978

[54] MULTI-MODE INTRUSION ALARM SYSTEM

[75] Inventors: Aaron A. Galvin, Lexington; L. Dennis Shapiro, Chestnut Hill; Valdemar Skov, Wayland, all of Mass.

[73] Assignee: American District Telegraph Company, New York, N.Y.

[21] Appl. No.: 677,661

[22] Filed: Apr. 16, 1976

[51] Int. Cl.[2] ..... G08B 29/00

[52] U.S. Cl. ..... 340/502; 340/506; 340/525

[58] Field of Search ..... 340/409, 415, 408, 213 Q, 340/213 R, 213.1, 412, 276

[56] References Cited

U.S. PATENT DOCUMENTS 3,264,626 8/1966 Mounce ..... 340/213.1

3,404,393 10/1968 Bliuice et al. ..... 340/409

3,686,668 8/1972 Durkee ..... 340/276

*Primary Examiner*—John W. Caldwell, Sr.

*Assistant Examiner*—Donnie L. Crosland

*Attorney, Agent, or Firm*—Weingarten, Maxham & Schurgin

[57] ABSTRACT

A multi-mode intrusion alarm system having three different operating modes for providing different indications of present and past occurrence of alarm signals from a plurality of sensors. The different modes allow determination of which sensor produced the alarm signal, investigation of the protected area after occurrence of an alarm signal without disturbing such determination and resetting of the system. The system can include circuitry for automatic mode selection and for providing a warning when the system has not been properly reset.

3 Claims, 4 Drawing Figures

MULTI-MODE INTRUSION ALARM SYSTEM

FIELD OF THE INVENTION

This invention relates to intrusion alarm systems and more specifically to intrusion alarm systems having a plurality of sensors and operative in different modes.

BACKGROUND OF THE INVENTION

In intrusion alarm systems, it is frequently necessary to employ more than one sensor in a system for protection of multiple areas or a large single area. As the number of areas protected by respective sensors increases, it becomes more important for a person responding to an alarm to be able to quickly and unambiguously determine which sensor or sensors have detected the intrusion which produced the alarm condition. Such an indication will allow a person responding to an alarm to go immediately to the particular area where an intrusion has been sensed. Furthermore, such a system will facilitate the determination and correction of transitory conditions producing false alarms. These false alarm conditions may no longer be present by the time a person has responded to the alarm condition, and having a definite indication of which sensor caused the false alarm is a helpful aid in determining what caused the false alarm. Additionally, testing of intrusion alarm systems having many sensors becomes more tedious as the number of sensors increase, frequently requiring evacuation of the protected areas in order to individually test each sensor and the associated alarm circuitry.

SUMMARY OF THE INVENTION

The present invention encompasses a multi-mode intrusion alarm system which allows the particular sensor which caused an alarm signal from among a plurality of alarm sensors to be quickly and easily determined. In the invention, a selector switch allows three different modes of operation of an alarm system to be chosen. When latch mode is selected, any sensor which detects an intrusion and produces an alarm signal also triggers an indicator showing which sensor has indicated an alarm condition, which indicator will remain on even after the alarm signal from the sensor has ceased, thereby allowing a determination of which sensor or sensors has caused an alarm signal. When freeze mode is selected, the present outputs of all the above-mentioned indicators are maintained in their present state. This allows a person responding to an alarm to put the intrusion alarm system in freeze mode and immediately investigate the premises without having his movement in protected areas causing the indicators to change state. After the investigation has been completed, if an intruder has not been found, the indicator may be examined to determine in which protected area the intrusion or false alarm occurred. When reset mode is selected, each of the indicators is reset. Upon the occurrence of an alarm signal from a sensor, the indicator for that sensor will indicate that an alarm signal from that sensor is currently present, and the indicator will automatically reset after the alarm signal from the sensor ceases.

DESCRIPTION OF THE DRAWINGS

These and other advantages of the invention will become more apparent upon reading the following detailed description and with reference to the following figures in which.

PREFERRED EMBODIMENT OF THE INVENTION

Figure 1:
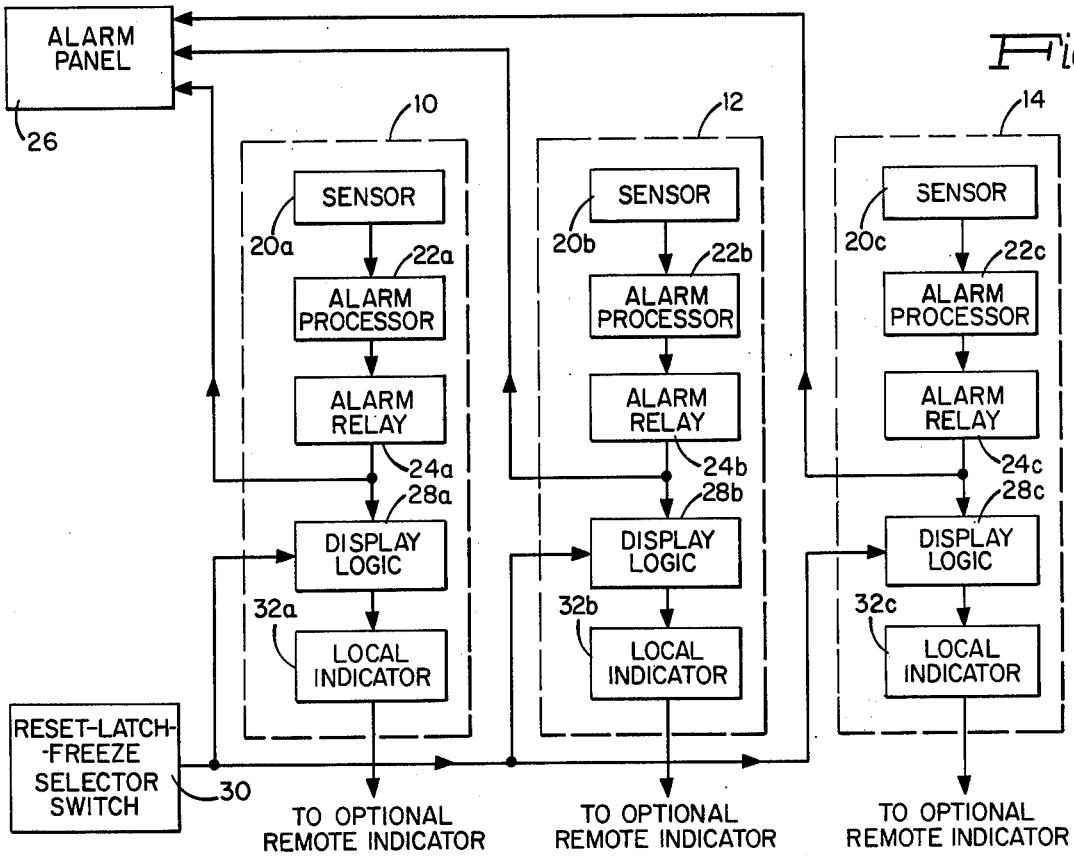
FIG. 1 is a block diagram of an intrusion alarm system incorporating the invention.

Referring to FIG. 1, there is shown an alarm system incorporating the novel features of the invention. The alarm system of FIG. 1 is shown having three alarm channels denoted as 10, 12, and 14, each of which is normally used for the protection of and the sensing of intrusions within a different area. The invention may be used with alarm system having a smaller or larger number of alarm channels than is shown, the particular number of alarm channels shown in FIG. 1 being chosen for exemplary purposes only.

Composing alarm channel 10 there is first a sensor **20*a*. This sensor may be any one of many different types commonly used in intrusion detection systems, including ultrasonic detectors, window pane disturbance detectors, light-beam detectors, and other types. The output signal from sensor 20*a* is applied to an alarm processor 22*a* which typically includes specialized circuitry for processing the output signals produced by the particular type of detector employed as sensor 20*a*. The alarm processor 22*a* monitors signals produced by sensor 20*a*, and upon detection of changes in the signals from sensor 20*a* indicating that an intrusion has occurred, alarm processor 22*a* produces an output signal indicating that the sensor 20*a* has detected an intrusion. This output signal is typically applied to an alarm relay 24*a*** to which are connected one or more indicators which serve to show when and where an intrusion has occurred.

Similarly to alarm channel 10, second and third alarm channels 12 and 14 each contain sensors **20*b* and 20*c*, alarm processors 22*b* and 22*c* and alarm relays 24*b* and 24*c*. The sensors 20 in each of the alarm channels may be identical or of different types, depending upon the type of protection desired in each area that is being monitored by a sensor. Accordingly, the alarm processors 22 associated with each sensor 20 will be of the appropriate type therefor. In some applications and with some particular types of sensors, it is advantageous for the several sensors to share part or all of the processor circuitry which monitors the signals therefrom, although separate outputs are normally provided for provision of signals denoting an alarm condition for each sensor. Therefore, while shown as separate blocks in FIG. 1, the alarm processors 22** may contain common circuitry.

The output signals from alarm relays **24*a*, 24*b*, and 24*c* of channels 10, 12, and 14 are typically applied to an alarm panel 26 containing indicators showing the current status of each of the alarm channels. In applications where alarm panel 26 is not continuously monitored, there is typically provided a means for summoning assistance upon the detection of an intrusion in any of the alarm channels. However, for reasons which will become apparent as the purposes of the invention are more fully explained, information available at the alarm panel 26 from alarm relays 24, which only shows the current alarm or non-alarm status of each of the sensors 20, may not be sufficient for optimal operation of the alarm system. Accordingly, circuitry may be added for providing further information useful in interpreting the outputs of the alarm sensors 20**.

As shown in FIG. 1, in alarm channel 10, the output from alarm relay 24*a* is further applied to display logic 28*a*. Signals from selector switch 30 are also applied to display logic 28*a*. Selector switch 30 allows an operator to choose among three different modes for the operation of display logic 28*a*. These modes are designated as reset mode, latch mode, and freeze mode.

When selector switch 30 is in reset mode, local indicator 32*a*, driven by signals from display logic 28*a*, will indicate an alarm during that time that the signal from alarm relay 24*a*, indicates that an intrusion is being detected by sensor 20*a*. Upon cessation of an alarm signal from alarm relay 24*a*, local indicator 32*a* will return to the non-alarm condition. When selector switch 30 is in latch mode, the occurrence of an alarm signal from any alarm relay 24 will cause the corresponding local indicator 32 to indicate an alarm condition, which indication will remain after the cessation of the alarm signal at the output of the alarm relay 24; and the output of the local indicator 32 can be restored to a non-alarm condition only by moving selector switch 30 to the reset position.

Selector switch 30 is used to select freeze mode only after an alarm signal has occurred. When selector switch 30 is moved to the freeze position, the display logics 28 in each alarm channel cause the associated local indicators 32 to remain in their current state, alarm or non-alarm. In other words, any local indicators 32 that indicate an alarm at the time that switch 30 is moved from latch mode to freeze mode will continue to indicate an alarm, and any indicators that were in the non-alarm state will remain in that state in spite of any alarm signals from alarm relays 24 which may occur thereafter. Note that the sensors 20 are still able to produce an alarm signal in this mode and indicate such an alarm at the alarm panel 26, even though the local indicators 32 are prevented from changing state.

The operating of selector switch 30 and the associated circuitry in a typical application would be as follows. Upon leaving the protected premises, for example each night, a proprietor would turn selector switch 30 to the reset position. This would cause each of the local indicators 32 to return to a non-alarm condition, assuming that none of the sensors 20 were then detecting the presence of an intruder. After resetting local indicators 32, selector switch 30 is then moved to the latch mode position where it remains during the time that the premises are to be protected by the intrusion alarm system. If an alarm occurs, the proprieter or an alarm-company representative in responding to the alarm would first remove selector switch 30 to the freeze mode position. Thereafter, a search may be made of the protected premises without disturbing the present state of each of the local indicators 32*a*. If no intruder is found, the indicators may be surveyed to determine which sensor caused the alarm so that it may be more quickly determined whether the alarm resulted from an intruder who has fled the premises or from something which has caused a false alarm.

Figure 2:
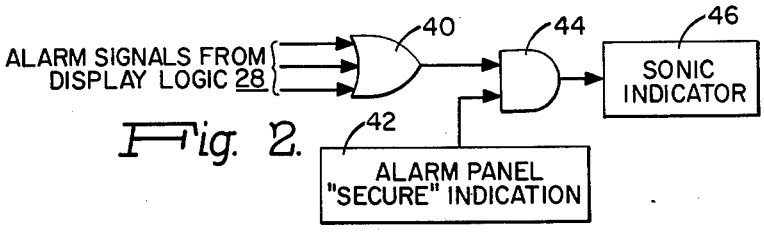
FIG. 2 shows circuitry which can be used to provide an automatic warning signal when the intrusion alarm system has not been properly reset.

As shown in FIG. 1, each of the local indicators 32 may be replaced or supplemented by an optional remote indicator which could be positioned near the exit from the protected premises along with selector switch 30. This would allow the proprietor to easily check that each of the indicators has been reset before returning the selector switch 30 to latch mode and leaving the protected premises. A simple warning device may be provided to indicate to the proprietor that selector switch 30 must be moved to the reset position momentarily to reset the indicator upon exiting the premises. Such a circuit is shown in FIG. 2. Signals from the display logic 28 in each of the alarm system channels are applied to an OR gate 40. If output from the display logic 28 in any of the alarm channels is high, indicating an alarm condition, the output of OR gate 40 will be forced into a logical high state. When the alarm system is switched to the "secure" mode at alarm panel 26, a logical high output, 42, is provided therefrom which is ANDed with the output from OR gate 40 by AND gate 44. The output of AND gate 44 is used to drive an indicator, such as the sonic indicator 46, for warning the proprietor upon exiting that one or more of the alarm channels' display logic 28 must be reset.

These remote indicators may be used to provide the proprietor with a simple means for testing that each of the sensors and alarm channels have operated properly during non-protected day hours. To do this, selector switch 30 is moved to the reset position at the beginning of the day to reset the display logic 28 in each of the alarm channels. Selector switch 30 is then moved to the latch position. Sometime later, each of the remote indicators is checked to see that it is in the alarm condition, thereby ascertaining that each of the alarm channels has operated, the sensors 20 detecting normal personnel motion in each of the protected areas. If an indicator is not in the alarm condition, either that particular alarm channel is inoperative or no one has been in that particular protected area since the time that the indicators were reset. A walk-through of the area in question should produce an alarm indication in the alarm channel being checked, the absence thereof indicating a malfunction in that particular alarm channel. Because the indicators remain on after being activated when selector switch 30 is in the latch position, maintaining the alarm system in latch mode during the day prevents unauthorized alarm sensor testing.

Figure 3:
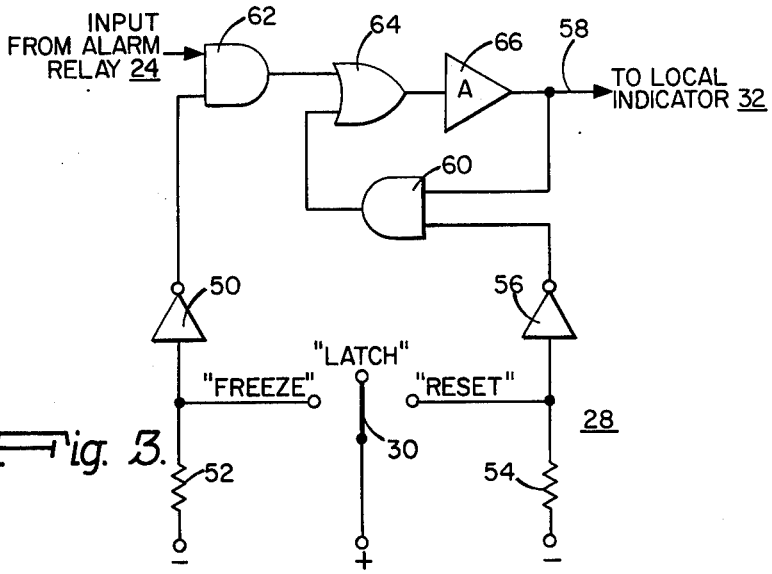
FIG. 3 is a more detailed circuit diagram of one embodiment of the display logic shown in FIG. 1.

FIG. 3 shows one method of implementing the display logic 28 shown in FIG. 1. Normally, selector switch 30 is in latch position. Resistor 52 connects the input of an inverter 50 with a voltage corresponding with a logic low level, denoted by "—". Similarly, resistor 54 connects the input of inverter 56 with a logical low level. This forces the outputs of inverters 50 and 56 to be at a logical high state enabling AND gates 60 and 62. The input from alarm relay 24 to AND gate 62 is normally low in the non-alarm condition, causing the output of AND gate 62 to be low. This low output from AND gate 62 is applied to an input of OR gate 64. If the display logic 28 has been reset since the last alarm signal, the output signal 58 therefrom is low and this low signal is applied to OR gate 64 through AND gate 60, enabled by the high output from inverter 56. Both inputs to OR gate 64 being low, the output thereof is also low. This low output is applied to a non-inverting buffer 66 which produces the low non-alarm output at the output 58 of display logic circuit 28, which output is applied to local indicator 32.

When sensor 20 detects an intrusion, the input and AND gate 62 from alarm relay 24 goes to a logical high level, causing the output of AND gate 62 to also go high. The high output from AND gate 62 forces the output of OR gate 64 to go high. This output is applied to non-inverting buffer 66, the output of which then switches to a logical high level providing a logical high signal at the output 58, indicating an alarm condition. The logical high output of buffer 66 is also applied to one input of AND gate 60, the other input to AND gate 60 being held at a logical high level by the previously described high output from inverter 56. This produces a logical high level at the output of AND gate 60 which is applied to an input of OR gate 64 forcing the output of OR gate 64 to remain high even if the input from alarm relay 24 to AND gate 62 subsequently goes low. Thus, AND gate 60, OR gate 64, and buffer 66 form a latch circuit, which switch from a logical low to a logical high level upon the occurrence of an alarm signal from alarm relay 24, and which thereafter maintain the output 58 of display logic 28 at a logical high level, even if the input signal from alarm relay 24 returns to a logical low level.

To reset the output of logic circuit 28, selector switch 30 is moved to the reset position. This connects the input of inverter 56 directly to a logical high level, shunting resistor 54; and the output of inverter 56 goes to a logical low level, forcing the output of AND gate 60 to a logical low level. If the input from alarm relay 24 applied through AND gate 62 to OR gate 64 is also low, the output of OR gate 64 goes to a logical low level, producing a logical low output from logic circuitry 28. The low output signal 58 is also applied to AND gate 60 so that the output of AND gate 60 remains at a logical low level when selector switch 30 is returned from the reset position to the latch position. In this manner, the latch circuit composed of AND gate 60, OR gate 64, and buffer 66 is reset to a logical low level.

When selector switch 30 is moved to the freeze position, the input to inverter 50 is connected directly to a logical high level, shunting resistor 52. The output of inverter 50 then goes to a logical low level, disabling AND gate 62 and preventing any changes in the input signal from alarm relay 24 from being transmitted by AND gate 62 to OR gate 64. Thus, the output latch circuitry composed of AND gate 60, OR gate 64 and buffer amplifier 66 will remain in its present state as long as selector switch 30 is in the freeze position.

Figure 4:
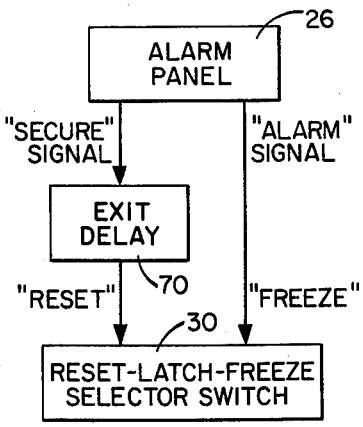
FIG. 4 is a block diagram showing how the intrusion alarm system mode may be automatically selected.

The function of selector switch 30 may be performed automatically by circuitry such as that shown in FIG. 4. This obviates the proprietor having to properly operate the selector switch 30 upon leaving the building at the end of the day and upon responding to an alarm. As shown in FIG. 4, when the alarm panel 26 is placed in the "secure" mode, preparatory to leaving the building, a "secure" signal is applied to exit delay circuit 70. This exit delay circuit 70 waits an appropriate length of time after the occurrence of the secure signal to allow the proprietor to leave the premises, after which a reset signal is briefly applied to selector switch 30, resetting the indicators of each of the alarm channels. The alarm system then returns to latch mode. Upon the detection of an intrusion, an "alarm" signal is produced by alarm panel 26 which is applied to the selector switch 30, causing display circuitry 28 to switch to freeze mode so that on responding to the alarm, the proprietor or alarm-company representative does not alter the indication of which sensor has alarmed.

Modifications to the preferred embodiment of the invention disclosed herein will occur to those skilled in the art. Accordingly, the preferred embodiments disclosed herein are not intended as limitations upon the invention; and the invention is to be limited only as indicated in the appended claims.

What is claimed is:

1. For use in an alarm system having a plurality of sensors for detecting an alarm condition and for providing an alarm signal representative thereof, an indicator system comprising:

selector means for selecting one of at least three modes and for providing latch, reset, and freeze signals to indicate the current selection of first, second, and third modes respectively;

a like plurality of latch means each corresponding to a respective one of said sensors and each having at least two output states, each of said latch means including:

means, operative during the presence of the latch signal from said selector means, for setting the latch means to the first output state in response to an alarm signal from the corresponding one of the plurality of sensors; and means, operative during the presence of the reset signal from said selector means and only in the absence of an alarm signal from the corresponding sensor, for resetting the latch means to the second output state; and means, operative during the occurrence of the freeze signal from the selector means, for rendering the latch means output state unalterable as long as the freeze signal is present.

2. The system of claim 1 further including a like plurality of indicator means each responsive to a corresponding one of the latch means for providing an indication of the output state thereof.

3. The system of claim 2 wherein the selector means includes a single pole three position selector switch.

* * * * *